United States Patent [19]

McCombs, Jr.

[11] 4,309,149

[45] Jan. 5, 1982

[54] VACUUM PUMP SWITCH

[75] Inventor: Howard L. McCombs, Jr., South Bend, Ind.

[73] Assignee: The Bendix Corporation, Southfield, Mich.

[21] Appl. No.: 127,681

[22] Filed: Mar. 6, 1980

[51] Int. Cl.[3] ..... F04B 49/00

[52] U.S. Cl. ..... 417/63; 200/83 A; 200/83 C; 200/83 S; 417/223

[58] Field of Search ..... 200/83 A, 83 B, 83 C, 200/83 J, 83 Q, 83 S, 83 SA, 83 T; 417/14, 15, 38, 212, 223, 316–319, 63; 137/386

[56] References Cited

U.S. PATENT DOCUMENTS

| | | | |
|---|---|---|---|
| 3,253,772 | 5/1966 | Parker | 417/316 |
| 3,950,946 | 4/1976 | Sakai et al. | 417/223 X |
| 4,190,752 | 2/1980 | Rogers | 200/83 Q |
| 4,212,591 | 7/1980 | Lamontagne et al. | 417/223 X |

*Primary Examiner*—William L. Freeh
*Assistant Examiner*—Edward Look
*Attorney, Agent, or Firm*—Leo H. McCormick, Jr.; Ken C. Decker

[57] ABSTRACT

A sensor responsive to a differential pressure between a fluid in a reservoir and the surrounding environment for operating a switch to activate and deactivate a pump and maintain the pressure of the fluid in the reservoir within a predetermined range.

11 Claims, 2 Drawing Figures

VACUUM PUMP SWITCH

BACKGROUND OF THE INVENTION

This invention relates to a sensor for controlling the operation of a pump to maintain the pressure level of a fluid in a reservoir within a predetermined pressure range.

Diesel and turbine powered engines do not produce a vacuum such as developed by an internal combustion engine. Unfortunately, many accessories on conventional vehicles are operated by a pressure differential created between air in the surrounding environment and vacuum. Rather than modify the operation of such vacuum operated accessories it has proven more economical to equip diesel and turbine powered vehicles with a vacuum pump and storage reservoir. Such vacuum pumps normally operate all the time that the diesel or turbine engine is running. Studies have shown that under normal and average driving conditions the vacuum pump need only operate about 10% of the time to meet the requirement of the accessories. Thus, it should be evident that a control capable of turning the pump on and off as needed to operate the accessories could result in energy savings while at the same time prolonging the life of the pump. Unfortunately, the differential pressure at which the pump turns on or off must closely match the pump's capability, while the differential pressure that a pump is capable of generating is a function of air density and temperature in addition to the normal factors such as efficiency, wear, etc.

SUMMARY OF THE INVENTION

This invention discloses a control with a differential pressure sensor having an output modified by the density of the air in the surrounding environment that matches the pump's capability to provide an operational signal that turns the pump on and off and thereby maintain a maximum differential pressure in a reservoir without continually operating the pump.

The differential pressure sensor has first and second diaphragms that separate a control chamber from a sensing chamber. The control chamber has an atmospheric port connected to the surrounding environment and a passage connected to the sensing chamber. An aneroid attached to a temperature sensitive bracket is connected to the first and second diaphragms by a linkage that extends into the control chamber. A lever pivotally attached to the linkage positions a first valve adjacent the atmosphere port and a second valve adjacent the passage. A first spring acts on the first diaphragm to hold the first valve opened and the second valve closed and allow air to freely enter the control chamber. With air in the control chamber and the sensing chamber connected to a reservoir, a pressure differential is created across the first and second diaphragm. The pressure differential creates a first force in the first diaphragm, which is modified by the aneroid, that attempts to move the linkage toward the second chamber in opposition to the first spring and a second force created in the second diaphragm. A third diaphragm in the second chamber is urged by a second spring into engagement with a switch that actuates an operational control of a pump connected to the reservoir. The pump changes the fluid pressure of the fluid in the reservoir to correspondingly change the pressure differential across the first and second diaphragms. When a predetermined fluid pressure develops, the first force is sufficient to overcome the first spring and second force and moves the linkage to sequentially close the first valve to the control chamber and open the second valve. Once the second valve opens, the pressure differential across the second diaphragm is eliminated and the first force immediately moves the linkage to allow substantially unrestricted communication between the sensing chamber and control chamber through the passage. With the passage opened, the fluid in the reservoir develops a pressure differential across the third diaphragm. This pressure differential creates a third force that overcomes the second spring to move the third diaphragm away from the switch and deactuate the operational control for the pump.

It is an advantage of this invention to provide a pump with an operational control that maintains a maximum differential pressure in a reservoir without continually operating the pump.

It is another advantage of this invention to provide a pressure sensor with an input corresponding to the density of the air in the surrounding environment to operate a pump such that an absolute fluid pressure is maintained in a reservoir.

It is an object of this invention to conserve energy produced by an engine through a sensor that activates and deactivates a switch to match the operation of a pump that maintains fluid pressure in a reservoir with the use of fluid from the reservoir.

These and other advantages and objects should be apparent from reading this specification while viewing the drawings.

DETAILED DESCRIPTION OF THE INVENTION

Figure 1:
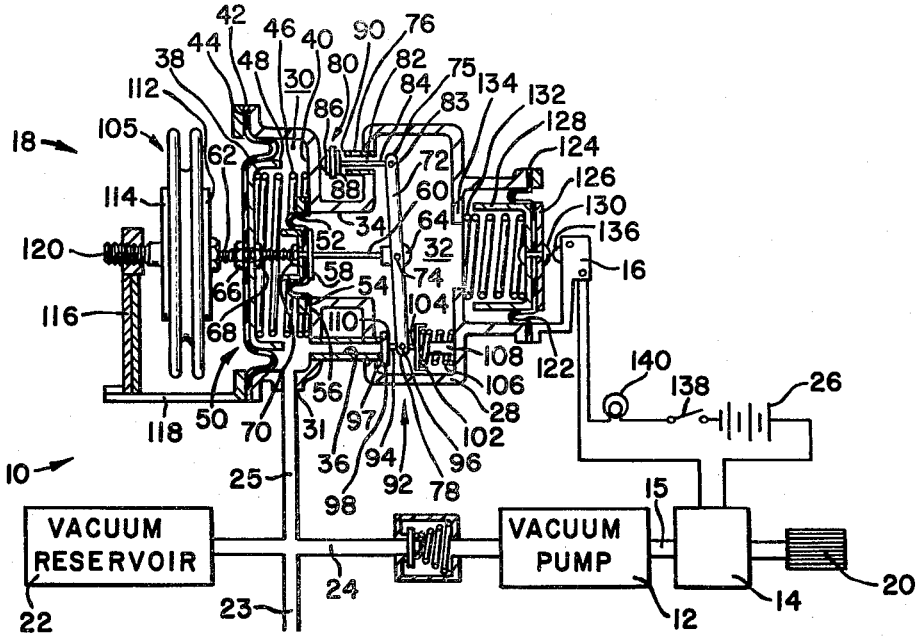
FIG. 1 is a schematic illustration of a pump system with a sectional view of a control mode according to the principles of this invention.

The pump system 10 shown in FIG. 1, for use in a vehicle, has a vacuum pump 12 which is connected to an engine through an electromagnetic clutch 14. The vacuum pump 12 is connected to a reservoir 22 by a conduit 24. The reservoir 22 is connected to the accessories in the vehicle by a conduit 23 and to a sensor 18. The sensor 18 which is responsive to a predetermined fluid pressure between the fluid in the reservoir 22 and the air in the surrounding environment provides switch 16 with an actuation signal to allow electrical energy to flow from source 26 to electromagnetic clutch 14. With electromagnetic clutch 14 in operation, shaft 20, which is connected to the engine the vehicle, rotates to provide vacuum pump 12 with operational power to evacuate air from reservoir 22. When the fluid pressure in reservoir 22 reaches a predetermined level as measured by sensor 18, switch 16 is deactivated to interrupt the communication of electrical energy from source 26 to electromagnetic clutch 14. With electrical energy to clutch 14 interrupted, the load on shaft 20 is essentially removed and the energy produced by the engine conserved for other needs.

In more particular detail, sensor 18 includes a housing 28 having a first chamber 30 separated from a second chamber 32 by a wall 40. Wall 40 has a bore 34 and a passage 36 located therein for connecting chamber 30 with chamber 32.

A first diaphragm 38, which has a bead 42 located in a groove 44, separates and seals chamber 30 from the surrounding environment. A spring 46 in chamber 30 acts on backing plate 48 to urge the diaphragm 38 and backing plate 48, hereinafter referred to as a first wall 50, away from wall 40.

A second diaphragm 52 has a bead 54 retained in a groove 56 in the housing 28 to prevent fluid communication between chambers 30 and 32 through bore 34. A shaft 60 has a first end 62 that extends through the first wall 50 and a second end 64 that extends through the second diaphragm and associated backing plate 58 into the second chamber 32. The first and second diaphragms 38 and 52 and corresponding backing plates 48 and 58 are fixed to shaft 60 by adjustable fasteners 66, 68 and 70.

A lever 72 is attached to the second end 64 of shaft 60 by a pivot pin 74. A first end 75 of lever 72 extends to a point adjacent an atmospheric port 76 and a second end 78 extends to a point adjacent passage 36 in wall 40.

A first valve 80 has a stem 82 with a first end 84 pivotally attached to end 75 of the lever 72 and a second end 86. The second end 86 has a resilient face 88 that is designed to engage seat 90 and seal atmosphere port 76 to prevent air from entering chamber 32 on movement of the shaft 60 toward chamber 32.

A second valve 92 has a stem 94 which is pivotally attached to the second end 78 of the lever 72 by pin 96. Stem 94 has a resilient face 97 on a first end 98 and a retainer cup 102 on a second end 104. A spring 106 which surrounds guide or stop 108 engages retainer cup 102 to urge the resilient face 98 toward a seat 110 of passage 36 to prevent fluid communication between chambers 30 and 32.

The first end 62 of shaft 60 is connected to a first end plate 112 of aneroid 105. A second end plate 114 of the aneroid 105 is connected to a temperature sensitive bi-metal arm 116 on support 118 by an adjustable pin 120. Movement of pin 120 provides a way of calibrating the sensor 10 in order to assure that the first valve 80 is opened and the second valve 92 is closed when the temperature and pressure of surrounding environment is 14.7 psi or 29–72 in Hg at 68° F. or 20° C. Even though 14.7 psi and 68° F. were selected, the adjuster pin 120 allows for a wide range in pressure and temperature calibration as a null or closure condition.

A third diaphragm 122 has a bead 124 fixed to the housing 28 to seal chamber 32 from the surrounding environment. The diaphragm 122 is sandwiched between an end plate 126 and a backing plate 128 by a fastener 130. A spring 132 extends from a stop 134 in the housing 28 into the backing plate 128 to urge fastener 130 toward contact 136 on switch 16.

MODE OF OPERATION OF THE INVENTION

Figure 2:
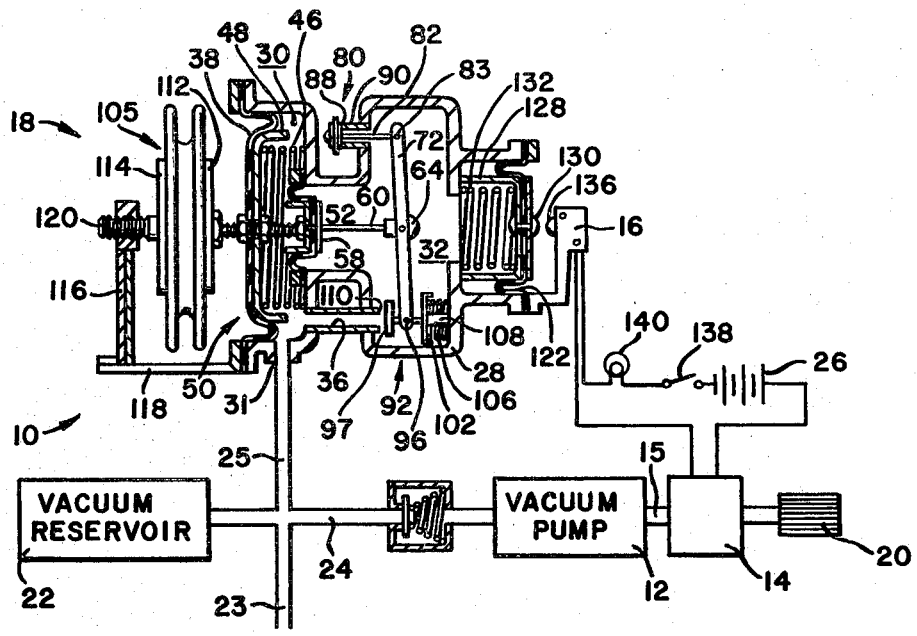
FIG. 2 is a sectional view of the control of FIG. 1 in a deactivated condition.

When an operator turns on the ignition switch 138 of a vehicle equipped with a pump system 10, an electrical circuit between source 26 and indicator light 140 is completed. However, switch 16 is also in the circuit and if the differential pressure between the fluid in reservoir 22 and the surrounding environment is at a predetermined level, switch 16 is in the deactivated condition as shown in FIG. 2 and indicator 140 remains in the off condition. However, if the fluid pressure in reservoir 22 is below a predetermined value, the sensor 18 closes switch 16 to complete the electrical circuit between battery 26 and electromagnetic clutch 14. With electrical energy present at the electromagnetic clutch 14, a rotary input is supplied to shaft 15 to operate vacuum pump 12. Vacuum pump 12 evacuates air from reservoir 22 to lower the fluid pressure level therein.

The fluid pressure level in reservoir 22 is freely communicated to sensing chamber 30 through port 31 in housing 28 by conduit 25.

The fluid pressure in the sensing chamber 30 and air in the surrounding environment and control chamber 32 produces a pressure differential across diaphragms 38 and 52 to produce a first force which is transmitted into shaft 60 through backing plate 48 and an opposite second force which is transmitted into shaft 60 through backing plate 58. Thus, the effective force acting on shaft 60 is the first force minus the second force. This effective force attempts to move shaft 60 toward the second chamber 32 in opposition to spring 46. In addition, a preload is applied to the first wall by the aneroid 105 to compensate for changes in atmospheric pressure and temperature above or below the calibrated pressure. After a period of time, vacuum pump 12 should have lowered the fluid pressure in reservoir sufficiently to allow the effective force produced by the fluid pressure differential between chamber 30 and the surrounding environment and chamber 32 to overcome spring 46 and the input from aneroid 105 to move shaft 60 toward the second chamber 32.

As shaft 60 moves toward chamber 32, spring 106 holds the second valve 92 in a substantially fixed position allowing lever 72 to pivot about pin 96 and move resilient face 88 on the first valve 80 against seat 90 to close communication from the surrounding environment into chamber 32.

Thereafter, further movement of shaft 60 toward chamber 32, causes lever 72 to pivot about pin 83 to overcome spring 106 and open the second valve 92 to initiate communication between chambers 32 and 30 through passage 36. With passage 36 opened, the fluid pressure in the sensing chamber 30 lowers the pressure in chamber 32 until the fluid pressure in both chambers 30 and 32 are equal. As the fluid pressure in chambers 30 and 32 approach each other, the pressure differential across diaphragm 52 and backing plate 58 is correspondingly reduced and eventually eliminated to terminate the second force on the shaft 60. Now the effective force on shaft 60 is equal to first force created by the pressure differential created across diaphragm 38 and backing plate 48. Thereafter, this first force moves the shaft 60 in opposition to spring 46 until spring 46 is fully collapsed and retainer 102 engages stop 108.

It should be understood that once the first force is equal to the second force and spring force, a small additional force added to the first force moves the diaphragms 38 and 52 to sequentially close valve 80 and open valve 92. Once valve 92 is opened, the first force causes the diaphragms 38 and 52 and linkage 60 to snap toward chamber 32 and allow the pressure to equalize between chambers 30 and 32.

As the fluid pressure in chamber 32 is lowered to the level of the fluid pressure in chamber 30, a pressure differential develops across diaphragm 122 with air in the surrounding environment. This pressure differential is transmitted into backing plate 128 as a third force. When a predetermined pressure differential is achieved, the third force overcomes spring 132 to move button or fastener 130 away from contact 136 and deactivates switch 16, to produce a condition in sensor 18 as illustrated in FIG. 2.

With switch 16 deactivated, electrical energy from source 26 is interrupted and electromagnetic clutch 14 disengaged to allow shaft 20 to thereafter rotate with the resistance load of the vacuum pump.

The vacuum or fluid in reservoir 22 is supplied to various engine accessories through conduit 23. As the fluid pressure level in reservoir 22 changes, the pressure differential across diaphragm 38 is reduced to change the first force. At some predetermined pressure, spring 46 overcomes the first force as modified by the input from aneroid 105 and moves shaft 60 toward chamber 30.

As shaft 60 moves toward chamber 30, spring 106 moves lever about pin 82, to close the second valve 92 by urging resilient face 97 against seat 110 to seal passage 36. Further movement of shaft 60 toward chamber 30, pivots lever 72 about pin 96 to open the first valve 80. With the first valve 80 opening, air from the surrounding environment enters chamber 32. Air in chamber 32 and the reservoir fluid in chamber 30 reestablish a pressure differential across diaphragm 52 to produce the second force which opposes the first force to hold the shaft 60 in the first chamber 30.

As air enters chamber 32, the pressure differential across diaphragm 122 is correspondingly reduced and eventually eliminated. At some pressure differential, spring 132 moves button or fastener 130 into engagement with contact 136 to activate switch 16. With switch 16 activated, electrical energy is transmitted from source 26 to electromagnetic clutch 14 to couple shaft 20 with vacuum pump 12. When vacuum pump 12 has lowered or changed the fluid pressure level in reservoir to a predetermined pressure, the first force in the sensor 18 moves the shaft 60 to again close the first valve 80 and open the second valve 92 to allow a pressure differential to move diaphragm 122 and backing plate 128 toward the second chamber 32 and deactivate switch 16 to interrupt the electrical energy to clutch 14.

Thus, the vacuum pump 12 is only operated when sensor 18 experiences a pressure differential change in the fluid pressure in reservoir 22 that would not be sufficient to meet the demands of accessories for a given time period. When the fluid pressure in reservoir 22 is sufficient to meet the accessories' demands for a preset time period, the vacuum pump 12 is deactivated and the power required to operate the pump used or conserved for other purposes.

It should be noted that the pressure differential in chamber 30 is increased when vacuum pum 12 is operating. The pressure differential in chamber 30 acts on both diaphragms 38 and 52 to produce an effective area of diaphragm 38 minus diaphragm 52. However, when vacuum pump 12 is turned off and passage 36 opened, the effective area is now the area of diaphragm 38. The relationship between the areas of diaphragm 38 and 52 establishes the hysteresis between off and on of switch 16. In addition, the force developed across diaphragm 52 provides the extra force or reduction in force that causes the snap action of the valves when pressure differential reaches a predetermined level.

I claim:

1. A control member comprising:

a housing having a first chamber connected to a second chamber by a bore and a passage, said first chamber being connected to a reservoir containing a fluid, said second chamber being connected to the surrounding environment through a port;

a first wall in said first chamber;

a second wall in said bore;

linkage means for connecting said first wall with said second wall, said linking means extending into said second chamber;

a first valve connected to said linkage means and aligned with said port for controlling communication between the surrounding environment and said second chamber;

a second valve connected to said linkage means and aligned with said passage for controlling communication between said first and second chambers;

first resilient means for urging said first wall away from said second chamber to bring said second valve into engagement with said housing to seal said passage and disengage said first valve from said port to allow air to flow into said second chamber, said fluid in the reservoir and first chamber creating a pressure differential across said first and second walls with air in the surrounding environment and second chamber, respectively, said pressure differential creating a first force for urging said first movable wall toward said second chamber and a second force in said second wall which with the first resilient means opposes said first force;

a third wall in said second chamber; and second resilient means for moving said third wall to activate a switch connected to a device that effects a pressure change in the fluid in said reservoir, said pressure change producing a corresponding change in said pressure differential which allows the resulting first force to overcome said first resilient means and resulting second force to move the first and second walls toward the second chamber and sequentially close said first valve and open said second valve, said reservoir fluid being communicated to said second chamber to eliminate the pressure differential across said second wall and thereafter allow the first force to move the first and second walls toward the second chamber in opposition to said first resilient means while a pressure differential is created across said third wall to develop a third force which overcomes said second resilient means and moves said third wall to deactivate said switch and thereby interrupt the effect of the device on the fluid in the reservoir.

2. In the control member as recited in claim 1, further including:

aneroid means connected to said first wall for modifying said first force to compensate for pressure changes in the air of the surrounding environment and thereby maintain substantially the same switch deactivation pressure differential.

3. In the control member as recited in claim 2, further including:

temperature responsive means for providing said aneroid means with an input to compensate for changes in temperature in the surrounding environment that could effect the actuation and deactivation of said switch.

4. In the control member as recited in claim 3, first wall includes:

a first diaphragm having a peripheral bead attached to said housing for segregating said first chamber from the surrounding environment; and a first backing plate associated with said first diaphragm for transmitting said first force into said linkage means.

5. In the control member as recited in claim 4, wherein said second wall includes:

a second diaphragm having a peripheral bead attached to said housing for segregating said bore from said first chamber; and a second backing plate associated with said second diaphragm for transmitting said second force into said linkage means.

6. In the control member as recited in claim 5 wherein said linkage means includes:

a shaft attached to said first and second diaphragms and backing plates and extending into said second chamber; and a lever pivotally attached to said shaft and first and second valves, said first and second wall movement being transferred through said shaft to said lever to sequentially operate said first and second valves.

7. In the control member as recited in claim 6, wherein said first valve includes:

a first stem pivotally attached to said lever and extending to a point adjacent said port; and a first head attached to said first stem, said first head engaging said port on movement of said first and second walls toward said second chamber, said first head flexing to allow said lever to move and open said second valve.

8. In the control member as recited in claim 7, wherein said second valve member includes:

a first stem pivotally attached to said lever and extending to a point adjacent said passage;

a second head attached to said second stem; and a spring connected to said stem for urging said second head toward said passage to sustain the segregation between said first and second chambers until after said first head engages said port.

9. In the control member, as recited in claim 8, further including:

a stop member connected to said housing for engaging said lever to limit the movement of said first wall toward said second chamber in response to said first force.

10. In the control member, as recited in claim 9 wherein said third wall includes:

a third diaphragm having a third bead attached to said housing for segregation said second chamber from the surrounding environment; and a third backing plate associated with said third diaphragm, said second resilient means engaging said third backing plate to hold said switch in an activated position when said first valve is opened and being overcome by said third force when the second valve is opened to deactivate said switch.

11. In the control member, as recited in claim 10, further including:

indicator means connected to said switch to provide an indication of the pressure of the fluid in the reservoir.

* * * * *